US008485524B2

(12) United States Patent
Yamaguchi

(10) Patent No.: US 8,485,524 B2
(45) Date of Patent: Jul. 16, 2013

(54) SHEET STORAGE APPARATUS AND IMAGE FORMING APPARATUS

(75) Inventor: Yoshihiro Yamaguchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 13/355,700

(22) Filed: Jan. 23, 2012

(65) Prior Publication Data

US 2012/0205860 A1 Aug. 16, 2012

(30) Foreign Application Priority Data

Feb. 10, 2011 (JP) ..... 2011-026722

(51) Int. Cl.
*B65H 31/20* (2006.01)

(52) U.S. Cl.
USPC ..... 271/223

(58) Field of Classification Search
USPC ..... 271/123, 233, 169, 170, 171, 220, 271/223, 104, 145
See application file for complete search history.

(56) References Cited

U.S. PATENT DOCUMENTS

| | | | | |
|---|---|---|---|---|
| 5,451,044 | A * | 9/1995 | Nakayama | 271/189 |
| 6,916,019 | B2 * | 7/2005 | Takahashi | 271/145 |
| 6,916,020 | B2 * | 7/2005 | Hasegawa | 271/171 |
| 7,429,041 | B2 * | 9/2008 | Yokoi | 271/162 |
| 7,516,956 | B2 * | 4/2009 | Allwright et al. | 271/171 |
| 7,527,259 | B2 * | 5/2009 | Meetze et al. | 271/171 |
| 7,694,958 | B2 * | 4/2010 | Nakamura | 271/171 |
| 7,708,272 | B2 * | 5/2010 | Van Opstal | 271/221 |
| 2006/0082044 | A1 * | 4/2006 | Aida | 271/145 |
| 2010/0001460 | A1 * | 1/2010 | Kawarago | 271/162 |
| 2011/0163495 | A1 * | 7/2011 | Aoyama et al. | 271/241 |
| 2013/0062827 | A1 * | 3/2013 | Fuda | 271/147 |

FOREIGN PATENT DOCUMENTS

JP 2002-274661 9/2002

* cited by examiner

*Primary Examiner* — Jeremy R Severson
(74) *Attorney, Agent, or Firm* — Smith, Gambrell & Russell, LLP

(57) ABSTRACT

A sheet storage apparatus 10*a* (10*b*) includes a sheet storage portion 31 that loads and stores a plurality of sheets P, and an end cursor (a restriction member) 50 that is disposed in the sheet storage portion 31 and restricts a sheet position. The end cursor 50 is composed of two or more members so as to be foldable and removably fixed in the sheet storage portion 31.

13 Claims, 20 Drawing Sheets

SHEET STORAGE APPARATUS AND IMAGE FORMING APPARATUS

INCORPORATION BY REFERENCE

This application is based on Japanese Patent Application No. 2011-26722 filed on Feb. 10, 2011, the contents of which are hereby incorporated by reference.

BACKGROUND

The present disclosure relates to an image forming apparatus that is typically used for a copy machine, a printer, a facsimile and the like, and a sheet storage apparatus that is used for the image forming apparatus.

In an image forming apparatus that is typically used for a copy machine, a printer and the like, a sheet storage apparatus capable of storing a plurality of sheets is disposed.

Here, for example, in a case where many users share one image forming apparatus, a sheet consumption amount for the one image forming apparatus increases. Because of this, a large capacity sheet storage apparatus capable of storing an increased number of sheets is developed.

As an example of such large capacity sheet storage apparatus, a paper sheet supply apparatus (sheet storage apparatus) is known, which includes a first paper sheet storage portion that loads a plurality of first paper sheets, a second paper sheet storage portion that loads a plurality of second paper sheets, and a convey fence that conveys the second paper sheets to the first paper sheet storage portion at a time. In this paper sheet supply apparatus, when conveying the plurality of second paper sheets to the first paper sheet storage portion at a time, to prevent an upper portion of the paper sheets from being deviated backward, a paper sheet deviation prevention means is unitarily formed with the convey fence. According to this, the paper sheet deviation (paper sheet collapse) is prevented, and paper sheet supply troubles such as feeding failure, double feeding, confused feeding order or the like are prevented.

Besides, in the above sheet storage apparatus, there are some cases where a restriction member, which restricts a sheet position in accordance with a sheet size (paper sheet size), is disposed.

However, in the above paper sheet supply apparatus, the restriction member does not have a structure that allows a user to easily perform a size change, accordingly, there is a problem that it is impossible to adjust the restriction member in accordance with a sheet size.

On the other hand, in a conventional large capacity sheet storage apparatus, there are only a small number of cases where sheets having different sheet sizes are frequently changed, accordingly, usually, the restriction member is fixed. Because of this, a structure is employed, in which the restriction member is not movable in accordance with a sheet size. Besides, even in a case where the restriction member is movable, a structure is employed, in which it is necessary to use a tool and the like, that is, a user cannot easily perform a size change. Because of this, even in the conventional large capacity sheet storage apparatus, there is a problem that it is impossible to adjust the restriction member in accordance with the sheet size.

SUMMARY

In light of the above problems, it is an object of the present disclosure to provide a sheet storage apparatus in which a restriction member for restricting a sheet position is easily adjustable in accordance with a sheet size.

To achieve the above object, a sheet storage apparatus according to an aspect of the present disclosure includes a sheet storage portion that loads and stores a plurality of sheets, and a restriction member that is disposed in the sheet storage portion and restricts a sheet position. And, the restriction member is composed of two or more members so as to be foldable and removably fixed in the sheet storage apparatus.

Still other objects of the present disclosure and specific advantages obtained by the present disclosure will become more apparent from the following detailed description of preferred embodiments.

Figure 14:
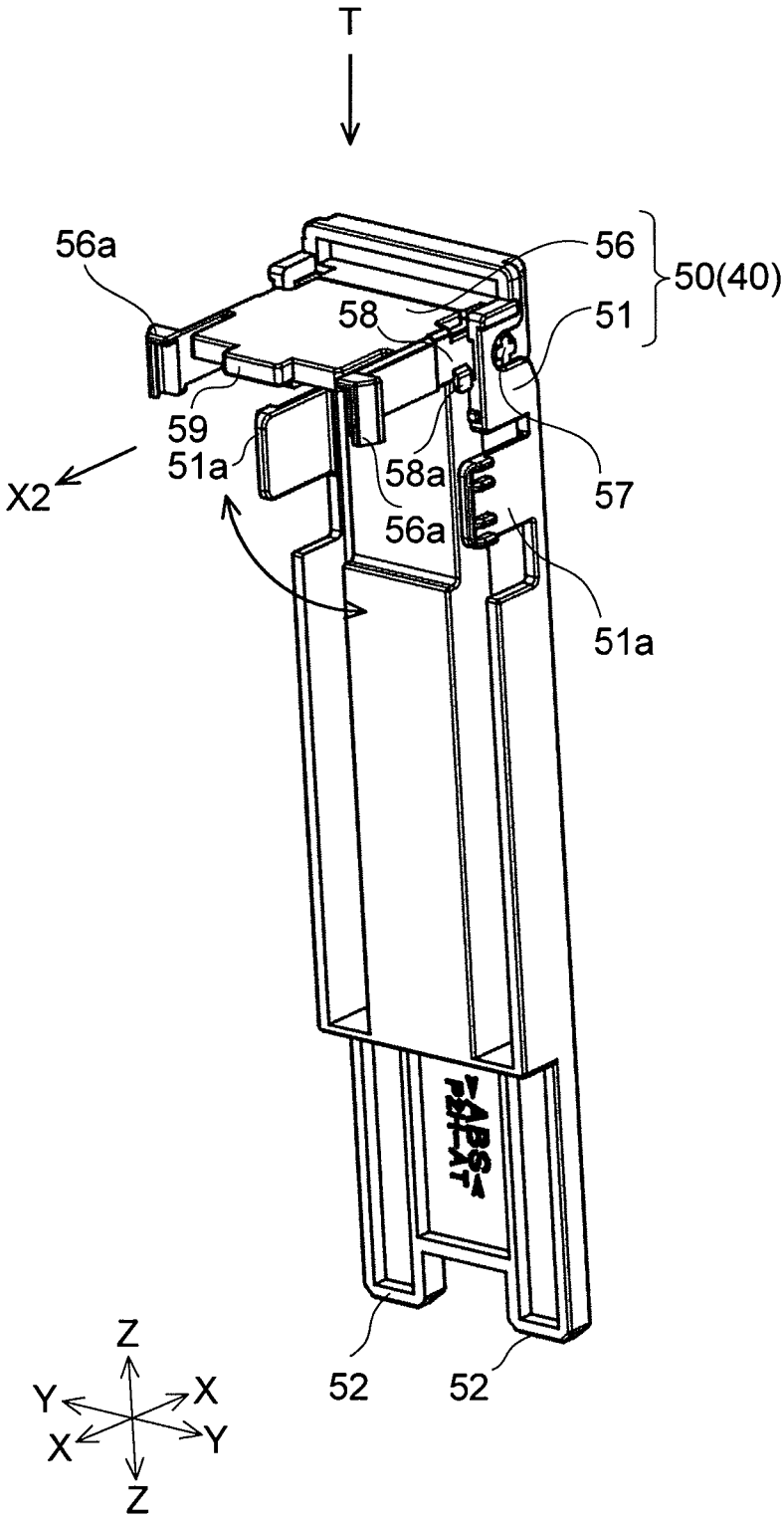

FIG. 14 is a perspective view (a view showing a state in which the second cursor 56 is unfolded) showing the end cursor 50 according to an embodiment of the present disclosure.

Figure 15:
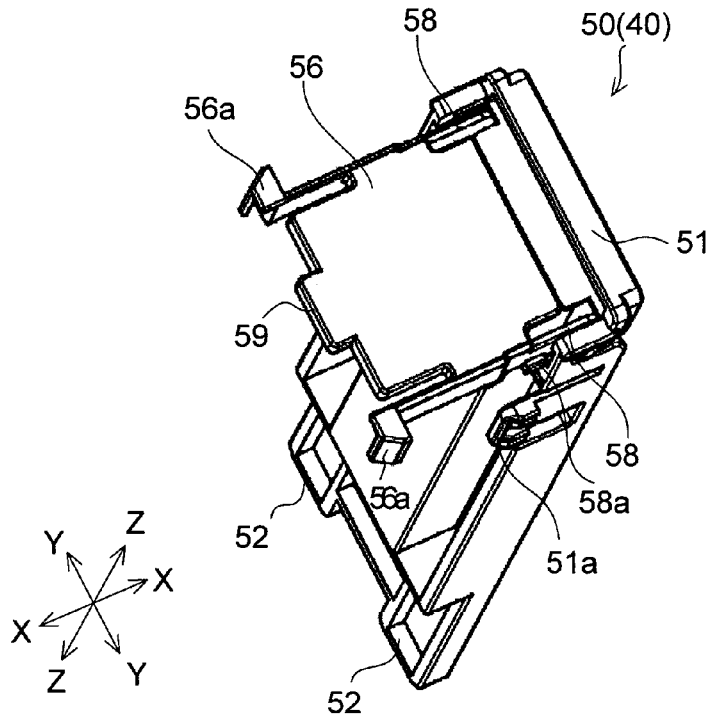

FIG. 15 is a perspective view (a view showing a state in which the second cursor 56 is unfolded) showing the end cursor 50 according to an embodiment of the present disclosure.

Figure 16:
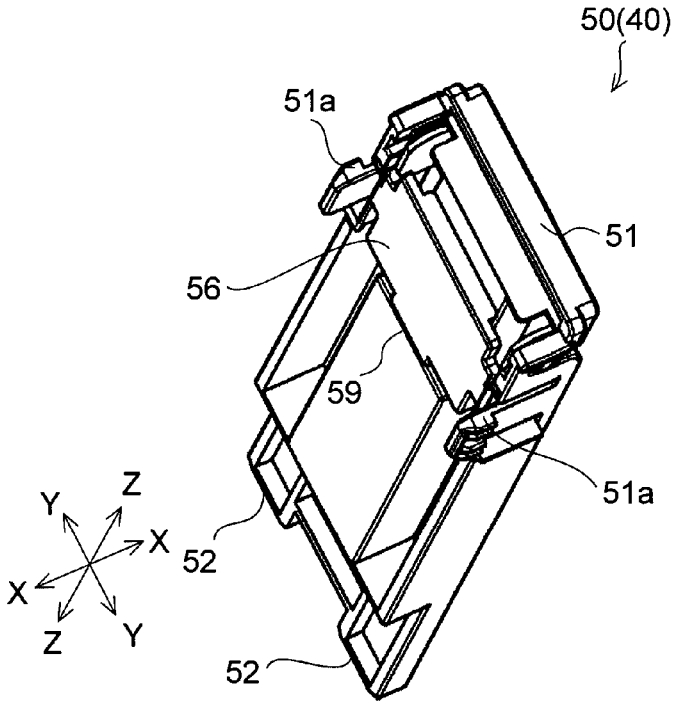

FIG. 16 is a perspective view (a view showing a state in which the second cursor 56 is folded) showing the end cursor 50 according to an embodiment of the present disclosure.

Figure 17:
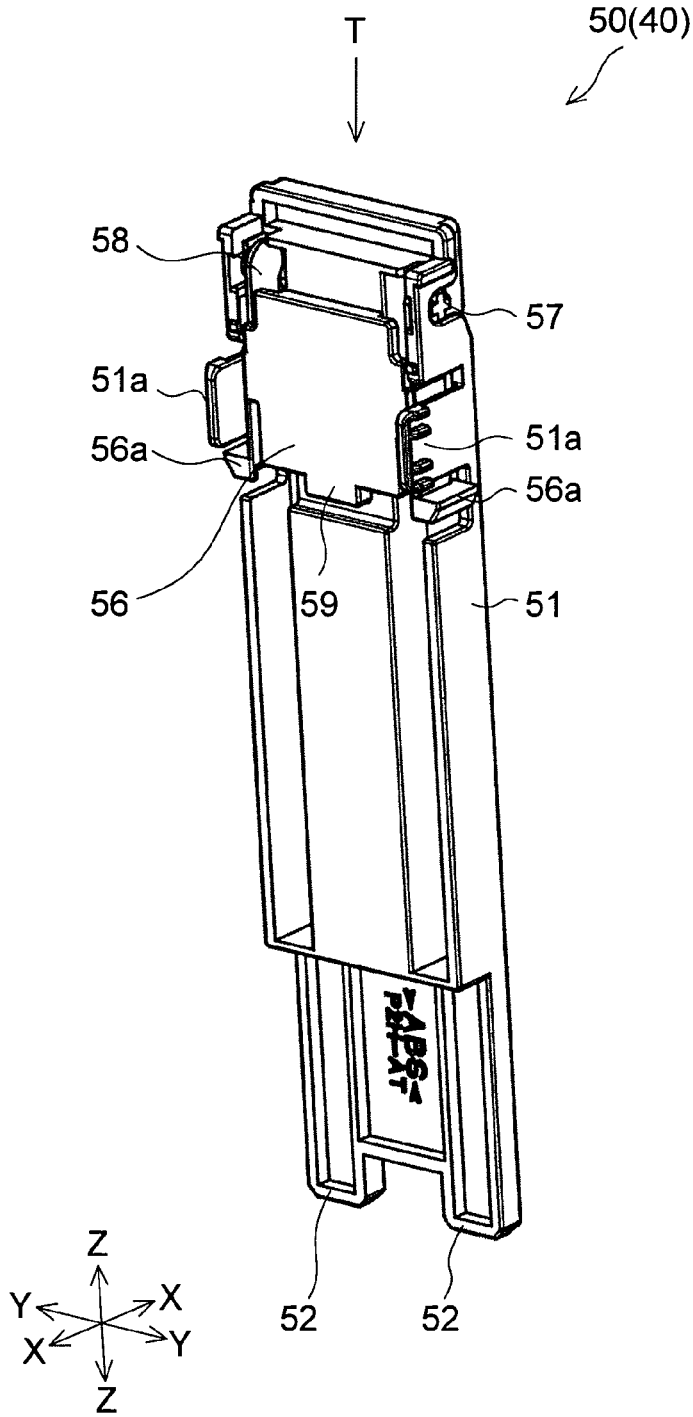

FIG. 17 is a perspective view (a view showing a state in which the second cursor 56 is folded) showing the end cursor 50 according to an embodiment of the present disclosure.

Figure 18:
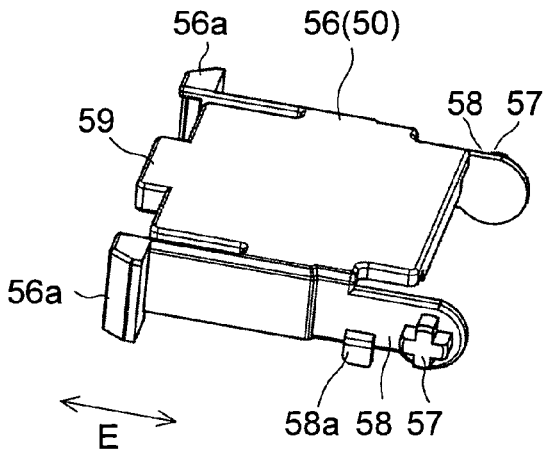

FIG. 18 is a perspective view showing the second cursor 56 of the end cursor 50 according to an embodiment of the present disclosure.

Figure 19:
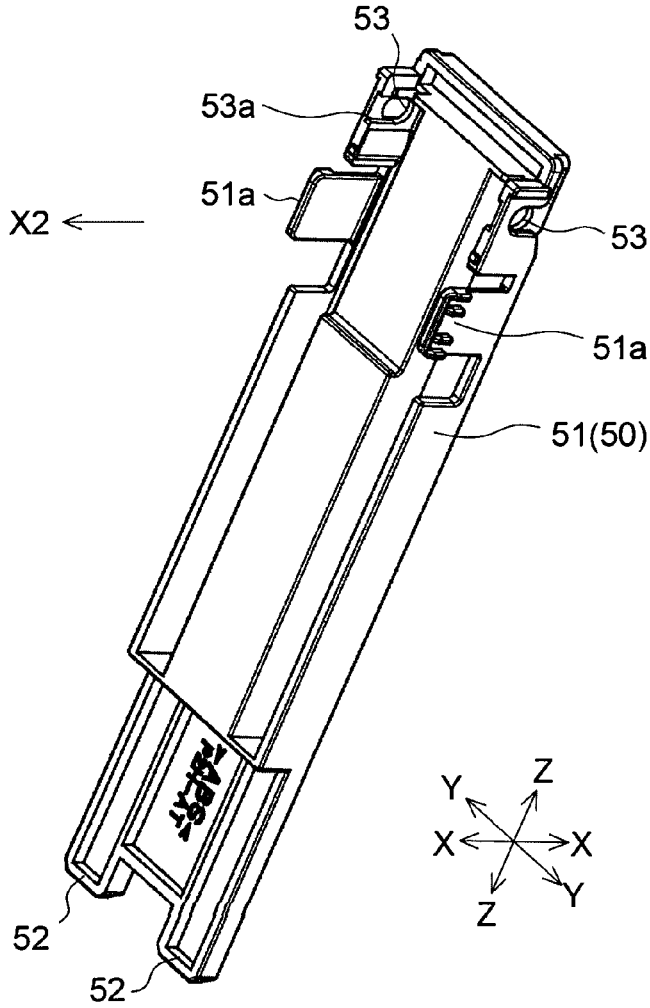

FIG. 19 is a perspective view showing a first cursor 51 of the end cursor 50 according to an embodiment of the present disclosure.

Figure 20:
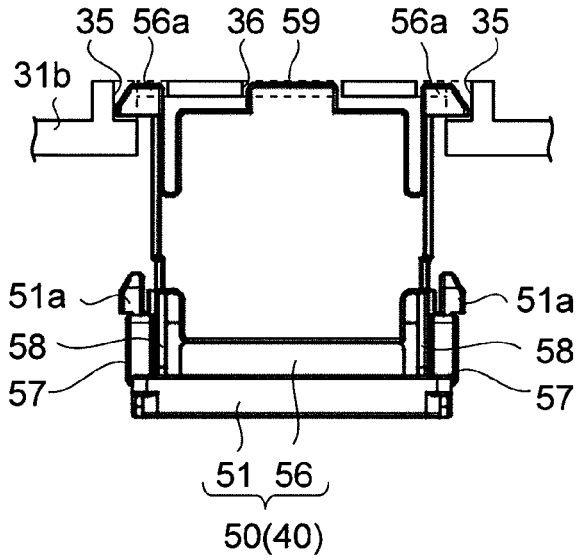

FIG. 20 is a view (a view in a T direction of FIG. 14: a view showing a state in which the second cursor 56 is mounted on a wall portion) when viewing, from top, the end cursor 50 according to an embodiment of the present disclosure.

Figure 21:
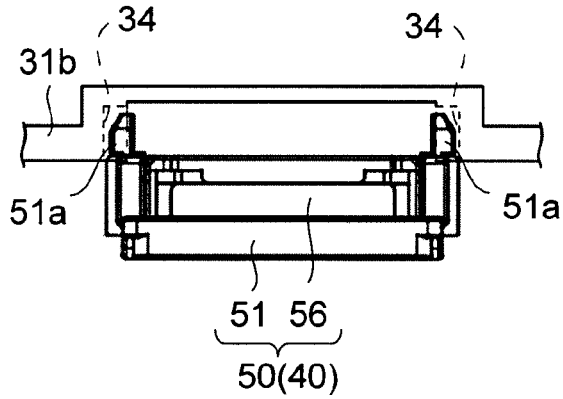

FIG. 21 is a view (a view in a T direction of FIG. 17: a view showing a state in which the first cursor 51 is mounted on a wall portion) when viewing, from top, the end cursor 50 according to an embodiment of the present disclosure.

Figure 22:
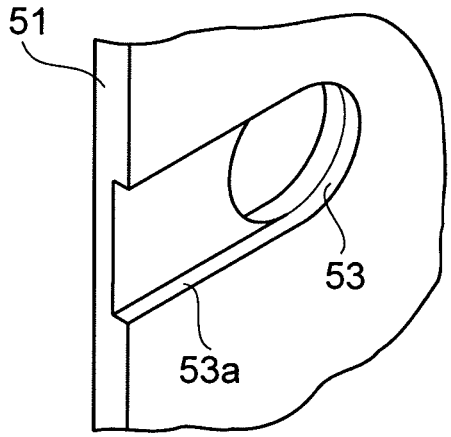

FIG. 22 is an enlarged schematic view of a bearing hole 53 of the first cursor 51 and other portions.

Figure 23:
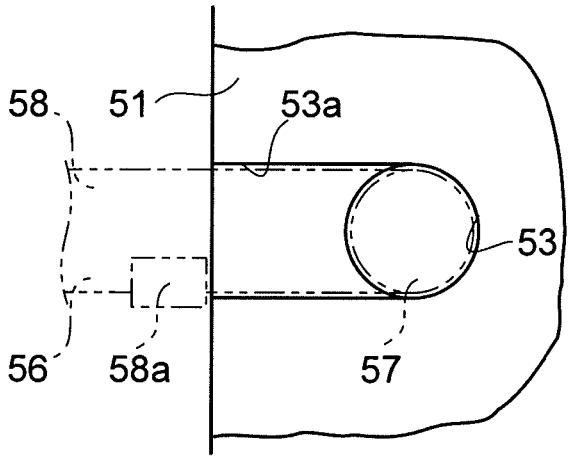

FIG. 23 is an enlarged schematic view of the bearing hole 53 of the first cursor 51 and other portions.

Figure 24:
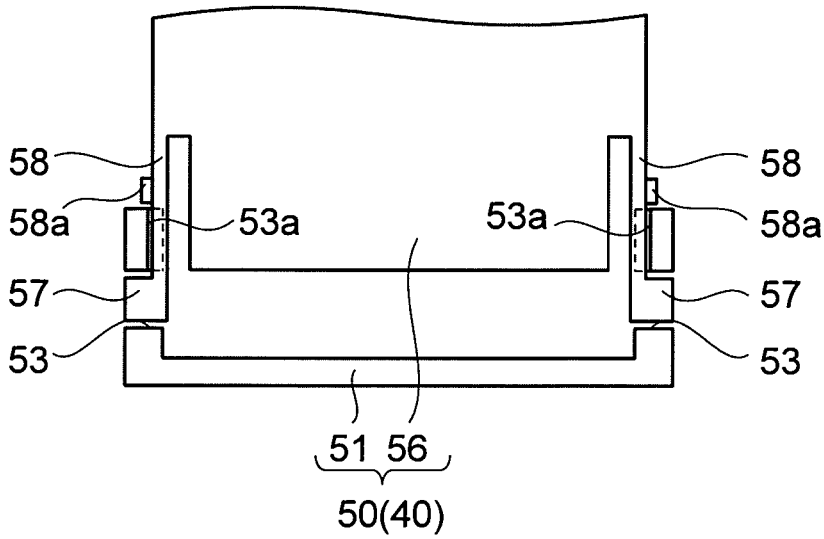

FIG. 24 is a view showing a state of an engagement between the first cursor 51 and the second cursor 56 of the end cursor 50 according to an embodiment of the present disclosure.

Figure 25:
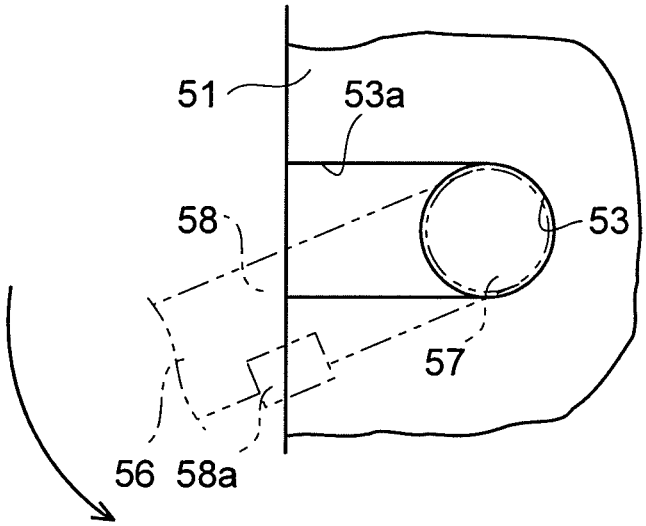

FIG. 25 is an enlarged schematic view of the bearing hole 53 of the first cursor 51 with which the second cursor 50 engages and other portions.

Figure 26:
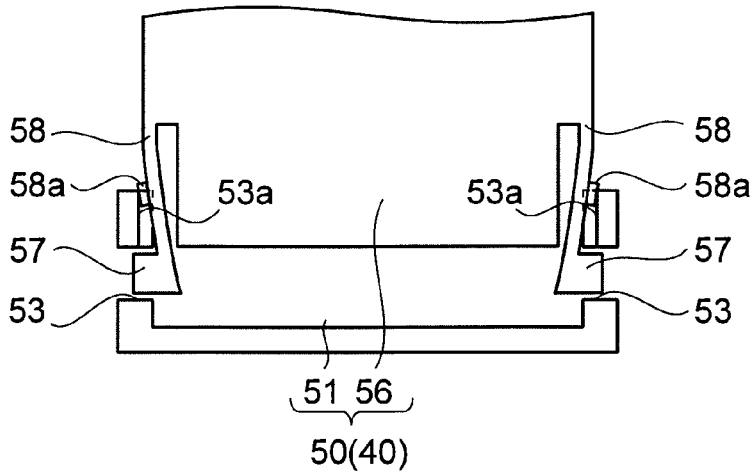

FIG. 26 is a view showing a state in which the second cursor 56 of the end cursor 50 according to an embodiment of the present disclosure is being folded.

Figure 27:
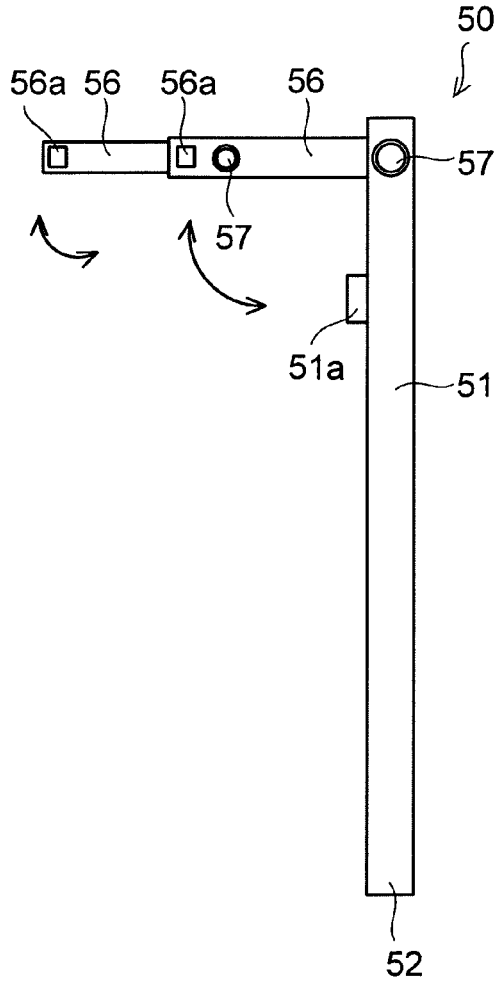

FIG. 27 is a view showing the end cursor 50 according to a modification of the present disclosure.

Figure 28:
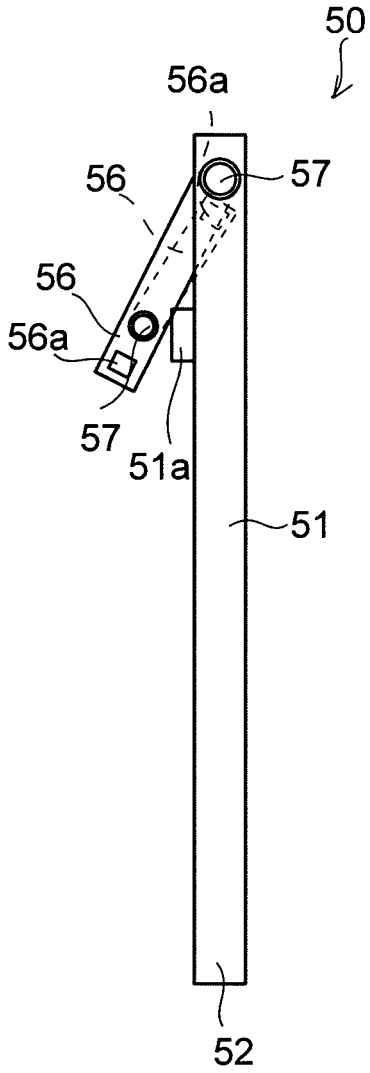

FIG. 28 is a view showing the end cursor 50 according to a modification of the present disclosure.

Figure 29:
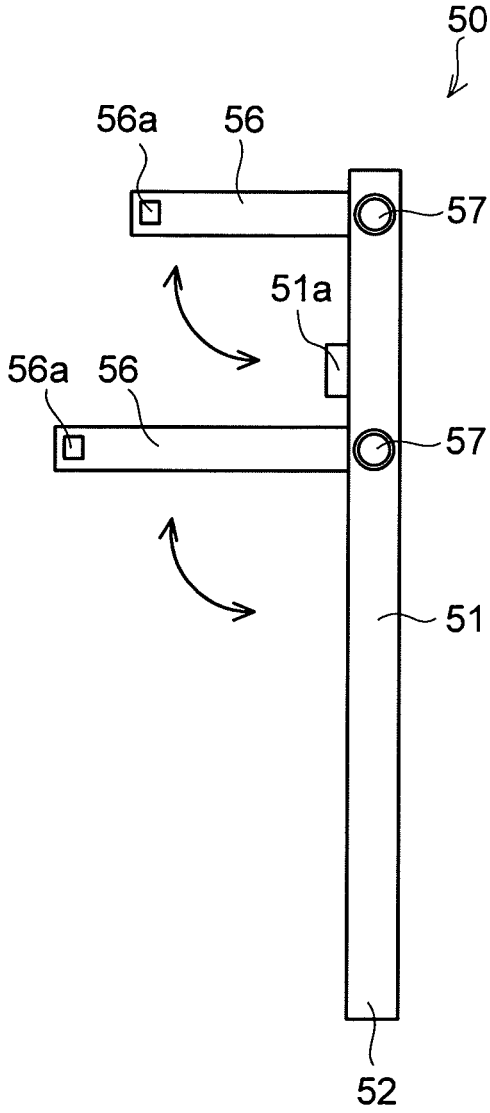

FIG. 29 is a view showing the end cursor 50 according to another modification of the present disclosure.

DETAILED DESCRIPTION

Hereinafter, embodiments realizing the present disclosure are detailed with reference to the drawings.

Figure 1:
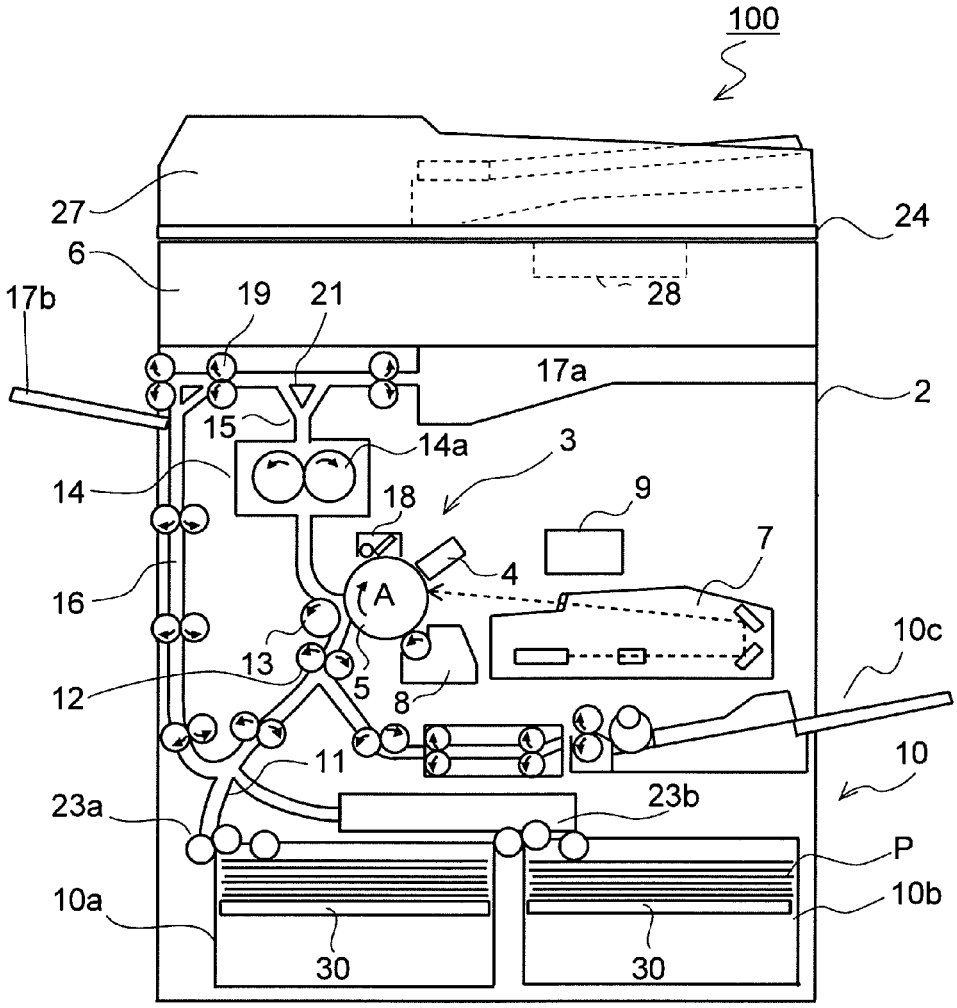
FIG. 1 is a schematic structural view of an image forming apparatus that includes sheet storage apparatuses 10*a*, 10*b* according to an embodiment of the present disclosure.

FIG. 1 is a schematic structural view of an image forming apparatus that includes a sheet storage apparatus according to an embodiment of the present disclosure. FIG. 1 is a sectional view when viewing the apparatus from a rear side. First, with reference to FIG. 1, a structure and operation of the image forming apparatus including the sheet storage apparatus are described. Hereinafter, a digital multi-function machine, which is an example of the image forming apparatus, is described.

In FIG. 1, in an image forming apparatus 100, when performing copy operation, an image read portion 6 described later reads image data of a document and converts the data into an image signal. On the other hand, in an image forming portion 3 of a multi-function machine main body 2, a photosensitive drum 5, which rotates in an A direction in the figure, is evenly electrified by an electrification unit 4. And, an electrostatic latent image is formed on the photosensitive drum 5 by a laser beam from an light exposure unit (laser scan unit and the like) 7 based on the document image data read by the image read portion 6, and a developer (hereinafter, called toner) is made to adhere to the electrostatic latent image by a development unit 8 so as to form a toner image. Toner is supplied to the development unit 8 from a toner container 9.

For the photosensitive drum 5 on which the toner image is formed as described above, a sheet (paper sheet) P is conveyed from a paper sheet supply mechanism 10 to the image forming portion 3 via a sheet convey path 11 and a pair of registration rollers 12, and in the image forming portion 3, the toner image on a surface of the photosensitive drum 5 is transferred onto the sheet by a transfer roller 13 (image transfer portion). And, the sheet on which the toner image is transferred is separated from the photosensitive drum 5 and conveyed to a fixing portion 14 that has a pair of fixing rollers 14*a*, where the toner image is fixed. The sheet passing the fixing portion 14 is sent to a sheet convey path 15 that branches off into a plurality of directions, and a convey direction of the sheet is changed by route change mechanisms 21, 22 that are disposed at a branch-off point of the sheet convey path 15 and have a plurality of route change guides, and the sheet is ejected to a sheet ejection portion, which includes a first ejection tray 17*a* and a second ejection tray 17*b*, as it is (or after being sent to a reverse convey path 16 to undergo double-side copy).

Besides, although not shown, an electricity removal apparatus for removing electric charges remaining on the surface of the photosensitive drum 5 is disposed in a downstream with respect to a cleaning apparatus 18. Further, the paper sheet supply mechanism 10 includes two sheet storage apparatuses 10*a* and 10*b* that are removably mounted in the multi-function machine main body 2 and store sheets, and a stack bypass (manual supply tray) 10*c* that is disposed above the sheet storage apparatuses 10*a* and 10*b*, and these connect, via the sheet convey path 11, to the image forming portion 3 that includes the photosensitive drum 5, the development unit 8 and the like.

In each of the sheet storage apparatuses 10*a* and 10*b*, a lift plate 30 vertically reciprocatable (in a Z direction) is disposed, and a sheet (paper sheet) P loaded on the lift plate 30 is pushed by the lift plate 30 against pickup rollers 23*a*, 23*b* that form the paper sheet supply mechanism 10, and conveyed to the sheet convey path 11. Structures of the sheet storage apparatuses 10*a* and 10*b* are described later.

The image read portion 6 is disposed in an upper portion of the apparatus main body, and a platen (document pusher) 24, which pushes and holds a document placed on a contact glass plate (not shown) of the image read portion 6, is disposed openably and closably on an upper portion of the apparatus main body, and a document convey apparatus 27 is disposed on the platen 24. Besides, an operation panel (not shown) is disposed on a front side of the image read portion 6.

The sheet convey path 15 specifically branches off into two, that is, left and right in a downstream with respect to the pair of fixing rollers 14*a*, one route of which (a route that branches off into a right direction in FIG. 1) is structured so as to communicate with the first ejection tray 17*a*. And, the other route (a route that branches off into a left direction in FIG. 1) branches off into two via a pair of convey rollers 19, one route of which (a route that branches off into a left direction in FIG. 1) is structured so as to communicate with the second ejection tray 17*b*. On the other hand, the other route (a route that braches off into a downward direction in FIG. 1) is structured so as to communicate with the reverse convey path 16.

Figure 2:
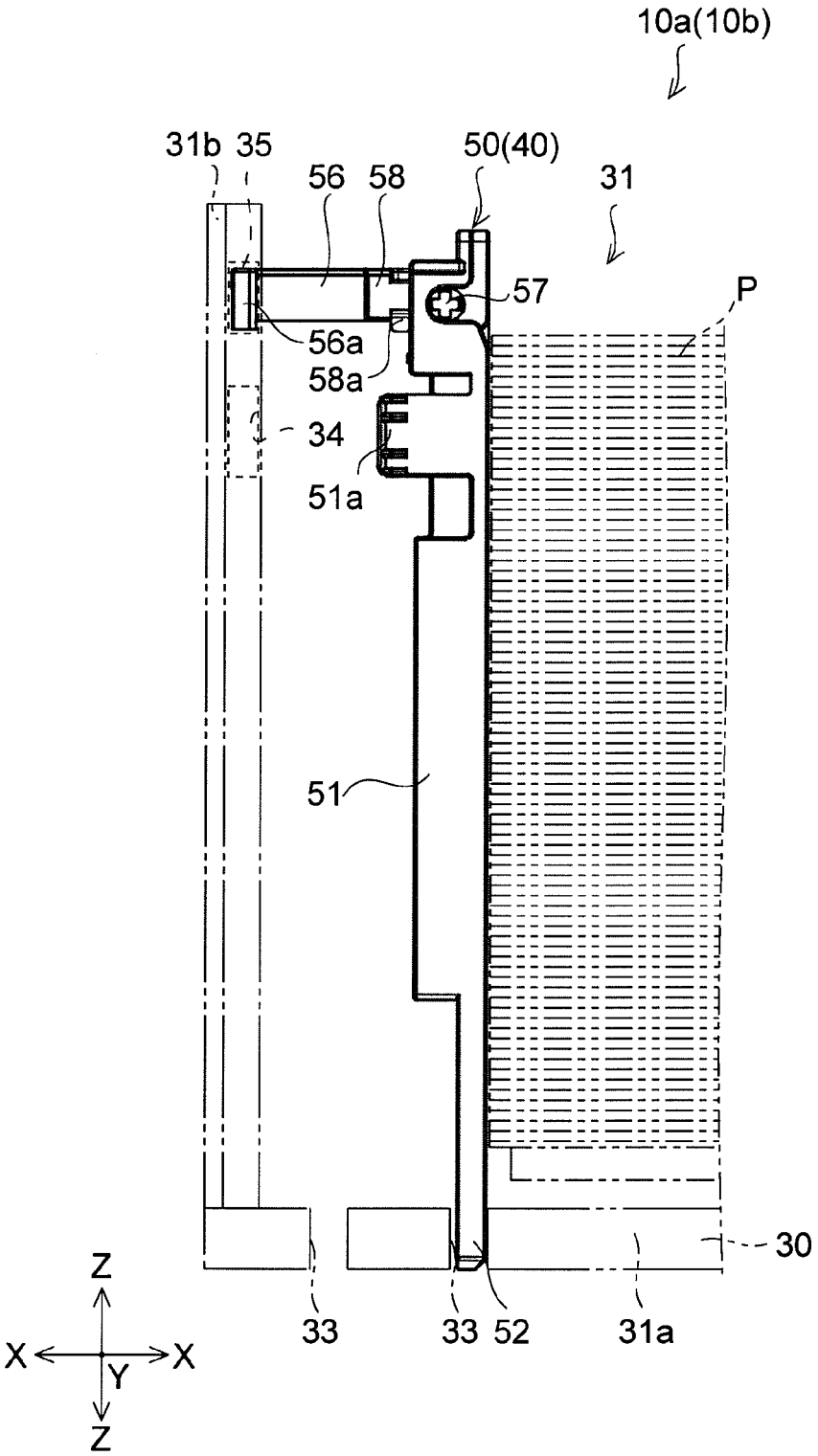
FIG. 2 is a view (a view showing a state with a second cursor 56 unfolded and mounted) showing a state in which an end cursor 50 according to an embodiment of the present disclosure is mounted on the sheet storage apparatuses 10*a* and 10*b*.
Figure 3:
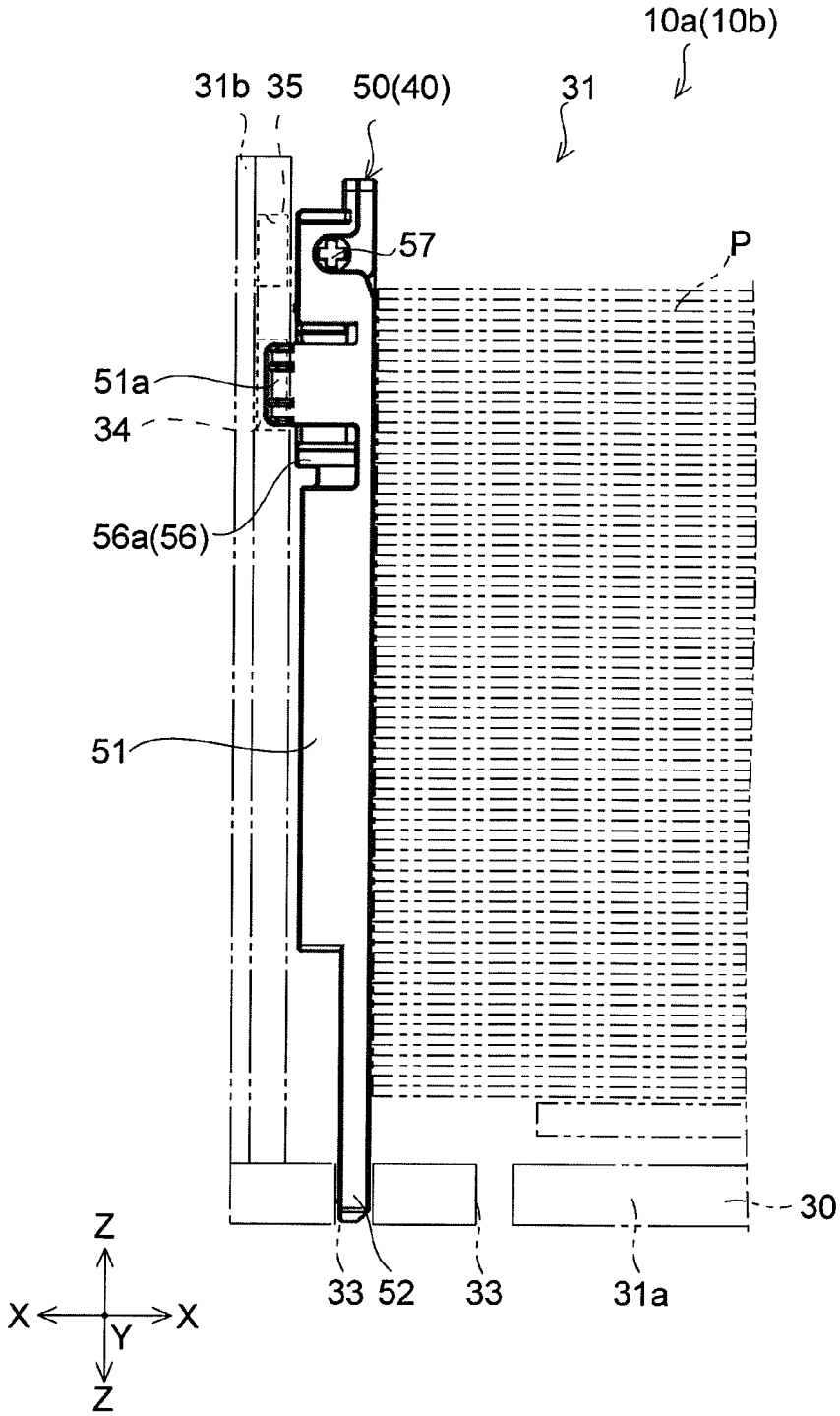
FIG. 3 is a view (a view showing a state with the second cursor 56 folded and mounted) showing a state in which the end cursor 50 according to an embodiment of the present disclosure is mounted on the sheet storage apparatuses 10*a* and 10*b*.
Figure 4:
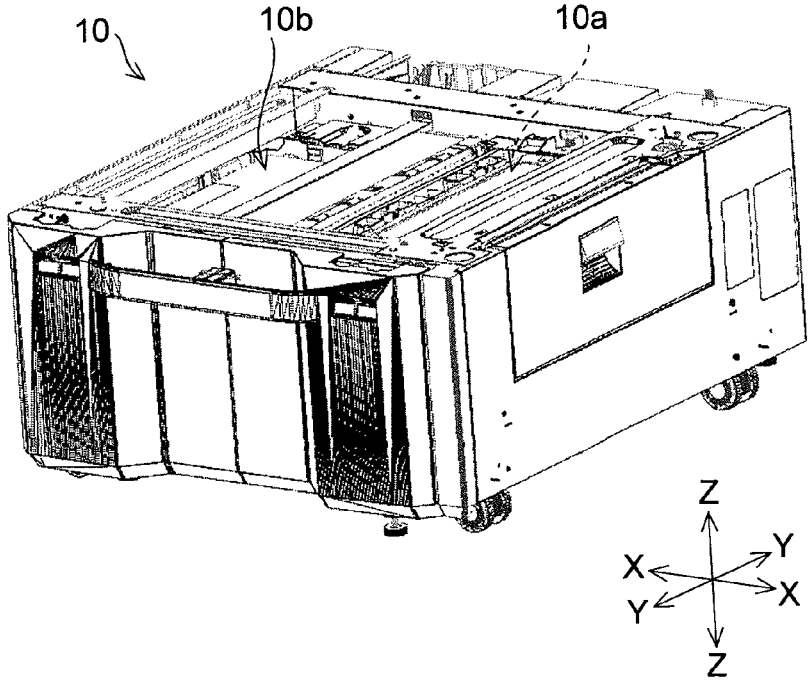
FIG. 4 is an appearance perspective view of a paper sheet supply mechanism 10 that includes the sheet storage apparatuses 10*a*, 10*b* according to an embodiment of the present disclosure.
Figure 5:
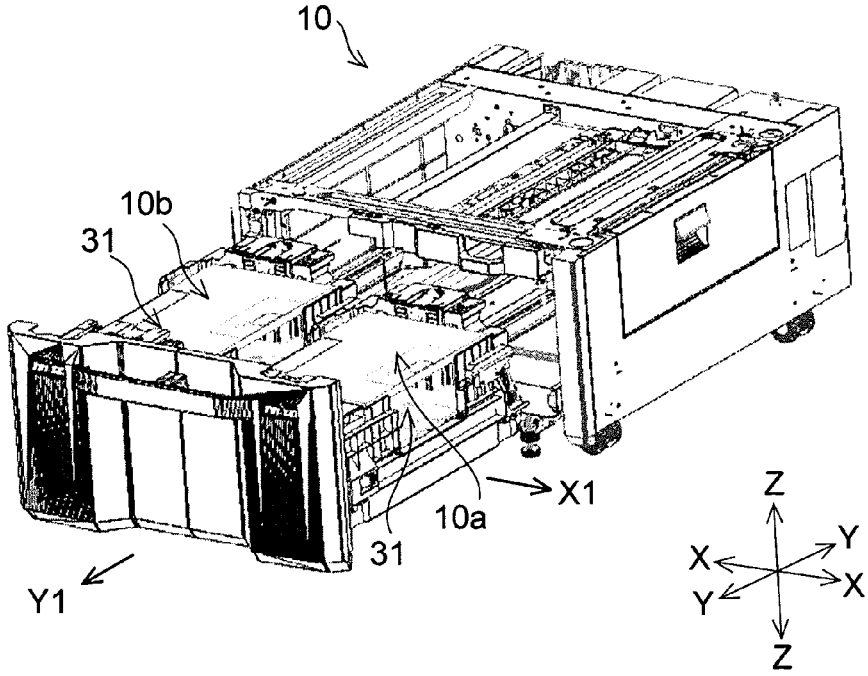
FIG. 5 is an appearance perspective view (a view with the sheet storage apparatuses 10*a*, 10*b* drawn out) of the paper sheet supply mechanism 10 that includes the sheet storage apparatuses 10*a*, 10*b* according to an embodiment of the present disclosure.

FIG. 2 and FIG. 3 are views each showing a state in which an end cursor 50 according to the embodiment of the present disclosure is mounted on the sheet storage apparatuses 10*a* and 10*b*. FIG. 4 and FIG. 5 are appearance perspective views of the paper sheet supply mechanism 10 that includes the sheet storage apparatuses 10*a*, 10*b* according to the embodiment of the present disclosure. FIG. 6 to FIG. 13 are views each showing the sheet storage apparatuses 10*a*, 10*b* according to the embodiment of the present disclosure. FIG. 14 to FIG. 26 are views each showing the end cursor 50 according to the embodiment of the present disclosure. Next, with reference to FIG. 2 to FIG. 26, the sheet storage apparatuses 10*a*, 10*b* according to the embodiment of the present disclosure are described.

As shown in FIG. 4 and FIG. 5, the two sheet storage apparatuses 10*a*, 10*b* are drawably housed in the paper sheet supply mechanism 10 of the image forming apparatus. These two sheet storage apparatuses 10*a*, 10*b*, as shown in FIG. 5 and FIG. 6, have the same structure as each other and are arranged such that sheet convey directions are the same as each other.

The sheet storage apparatuses 10*a*, 10*b* are each a large capacity type that is able to store 1,000 or more than 1,000 sheets P, and have a sheet storage portion 31 that loads and stores many sheets P. The sheet P is supplied to the sheet storage apparatuses 10*a*, 10*b* from above the sheet storage portion 31. Besides, the sheet storage apparatuses 10*a*, 10*b* are structured such that the sheet P is conveyed in a direction perpendicular to a draw-out direction (Y1 direction). In other words, in the present embodiment, the sheet convey direction (X1 direction) is perpendicular to the draw-out direction (Y1 direction) when viewed from top.

Hereinafter, a structure of the sheet storage apparatus 10*a* is more detailed. Here, a structure of the sheet storage apparatus 10*b* is the same as the sheet storage apparatus 10*a*, accordingly, description of it is skipped.

Figure 6:
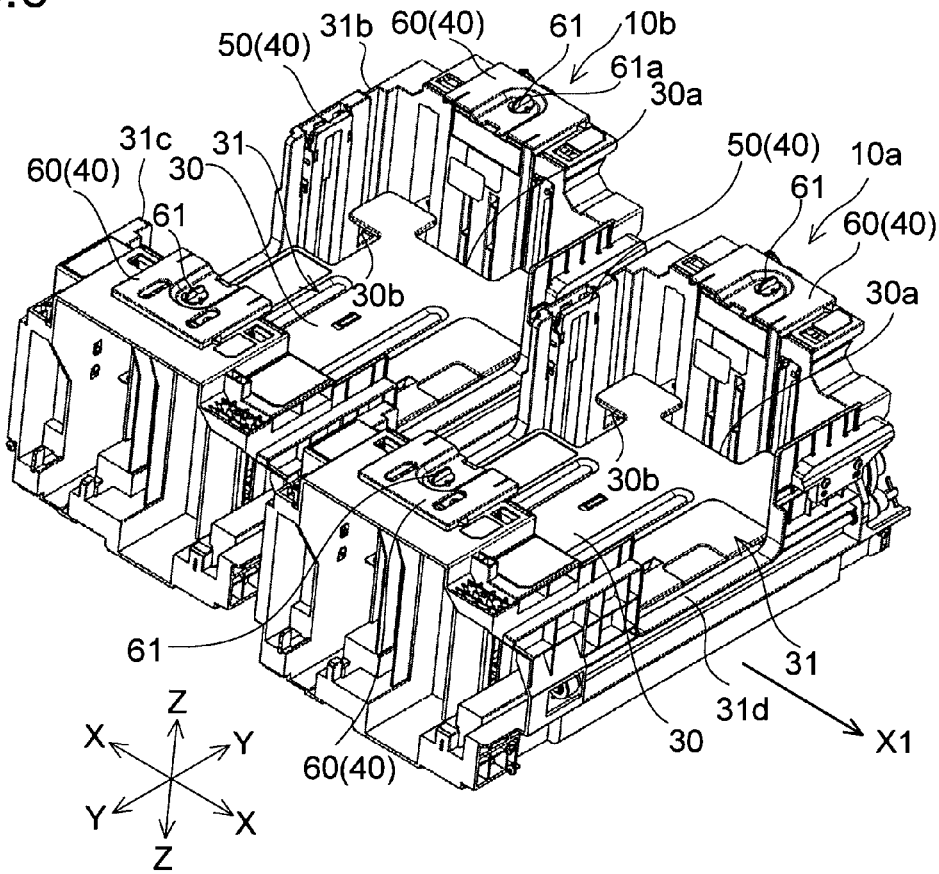
FIG. 6 is a perspective view showing the sheet storage apparatuses 10*a*, 10*b* according to an embodiment of the present disclosure.
Figure 7:
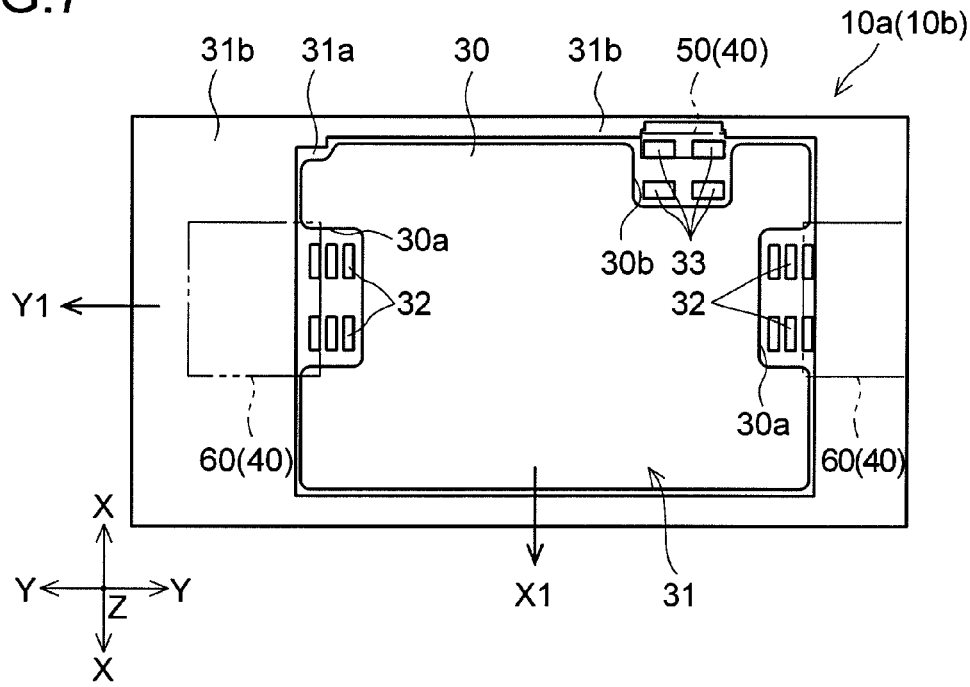
FIG. 7 is a plan view schematically showing the sheet storage apparatuses 10*a*, 10*b* according to an embodiment of the present disclosure.
Figure 8:
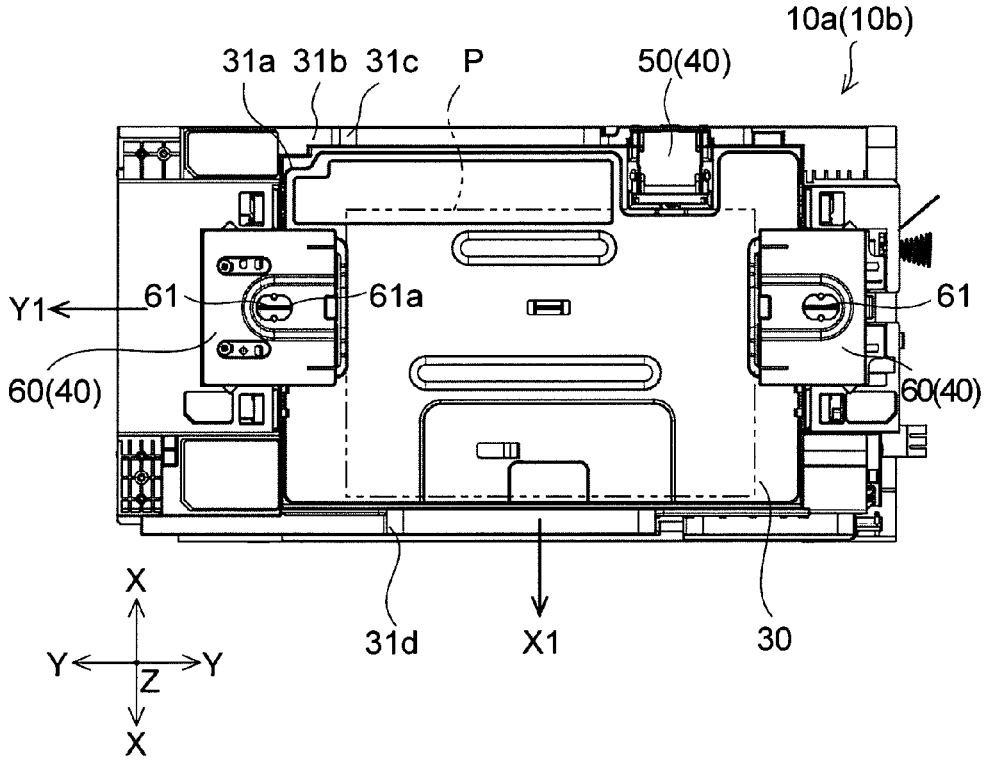
FIG. 8 is a plan view (a view showing a state in which the end cursor 50 is mounted with the second cursor 56 unfolded) showing the sheet storage apparatuses 10*a*, 10*b* according to an embodiment of the present disclosure.
Figure 9:
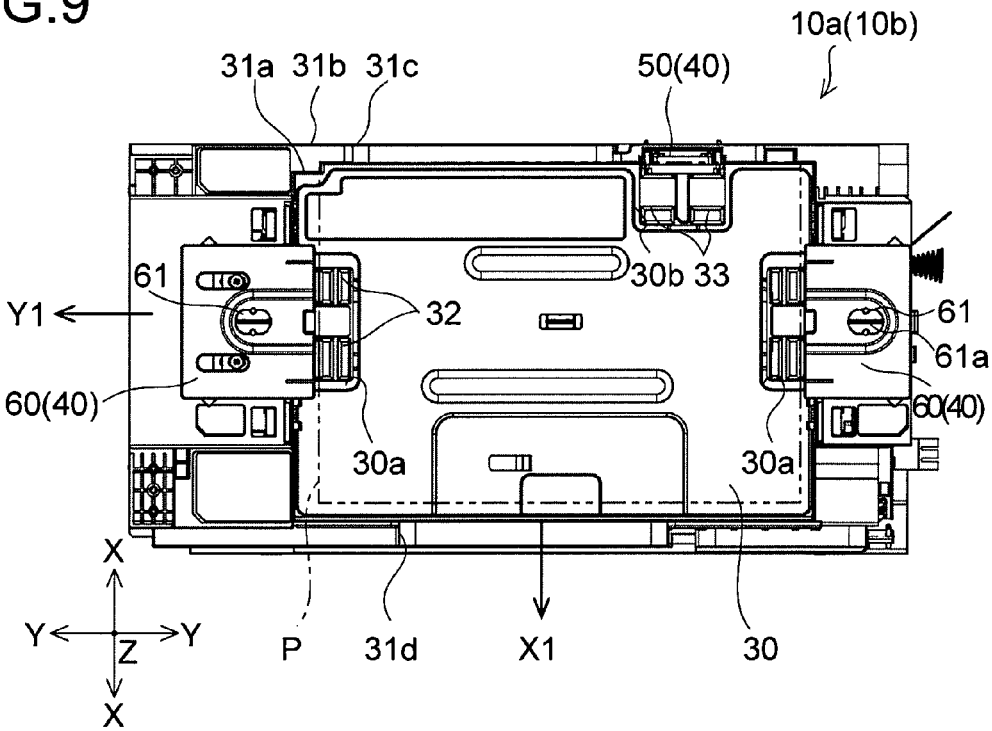
FIG. 9 is a plan view (a view showing a state in which the end cursor 50 is mounted with the second cursor 56 folded) showing the sheet storage apparatuses 10*a*, 10*b* according to an embodiment of the present disclosure.

As shown in FIG. 6 and FIG. 7, the sheet storage portion 31 of the sheet storage apparatus 10*a* has a bottom portion 31*a* (see FIG. 7) and a wall portion 31*b*. Besides, in the sheet storage portion 31 (in a region enclosed by the wall portion 31*b*) of the sheet storage apparatus 10*a*, the lift plate 30 movable vertically (the Z direction) is disposed. And, as shown in FIG. 8 and FIG. 9, a structure is employed, in which the many sheets P stored in the sheet storage apparatus 10*a* are loaded on the lift plate 30. Because of this, for example, the lift plate 30 moves upward, whereby the sheet P loaded on the lift plate 30 is raised upward so as to be pushed against the pickup roller 23*a*.

Besides, as shown in FIG. 10 to FIG. 13, in the sheet storage portion 31, the wall portions 31*b* are provided with supply opening portions 31*c*, 31*d* in an upstream and a downstream of the convey direction, when supplying the sheets P from above the sheet storage portion 31, the many sheets P (see FIG. 2 and FIG. 3) are loaded on the lift plate 30 through the supply opening portions 31*c*, 31*d* by hand.

Besides, in the sheet storage portion 31, a cursor 40, which restricts a sheet position so as to position the sheet P, is disposed upright. This cursor 40 is structured so as to include an end cursor 50 that has a positioning function in the sheet convey direction (X1 direction) and restricts a back end position of the sheet P, and a pair of side cursors 60 that have a positioning function in a direction (Y direction) perpendicular to the sheet convey direction (X1 direction). The end cursor 50 has a function to align the back ends of the sheets P, and the pair of side cursors 60 have a function to position the sheets P in a width direction (Y direction). And, by disposing the end cursor 50 and the side cursor 60 in a predetermined position, the sheets P having a predetermined size are storable at a predetermined position. Besides, the end cursor 50 to the number of one is disposed on the wall portion 31*b* at an opposite position with respect to the sheet convey direction (X1 direction). Here, the cursor 40 is an example of a "restriction member" of the present disclosure. Besides, the end cursor 50 and the side cursor 60 are examples of an "end restriction member" and a "side restriction member" of the present disclosure, respectively.

Here, in the present embodiment, the side cursor 60 and the end cursor 50 are each removably fixed in the sheet storage portion 31. Specifically, as shown in FIG. 7, the bottom portion 31*a* of the sheet storage portion 31 is provided with a plurality of first hole portions 32 into which the side cursor 60 is inserted, and a plurality of second hole portions 33 into which the end cursor 50 is inserted. And, the side cursor 60 and the end cursor 50 are inserted into one of the first hole portions 32 and one of the second hole portions 33 respectively, whereby the side cursor 60 and the end cursor 50 are removably fixed. Here, a short edge and a long edge of the lift plate 30 are partially provided with cutout portions 30*a*, 30*b*. And, thanks to the cutout portions 30*a* and 30*b*, a structure is obtained in which the first hole portion 32 and the second hole portion 33 are not covered by the lift plate 30.

Besides, the pair of side cursors 60 are each composed of a plate-shaped member that has a substantially L shape, and a lower portion of the side cursor 60 is inserted in a predetermined first hole portion 32. However, by only inserting the side cursor 60 into the first hole portion 32, the side cursor 60 is likely to shake. In a case where the side cursor 60 shakes, a sheet deviation occurs, which causes feeding failure, double feeding, confused feeding order and the like. Because of this, as shown in FIG. 6 and FIG. 8, the side cursor 60 has its upper portion fixed by a fastener 61 to an upper surface of the wall portion 31*b*. According to this, even in a case where a large number of sheets P are stored, the shaking of the side cursor 60 is curbed.

Besides, the plurality of first hole portions 32 are disposed so as to deal with a plurality of kinds (e.g., three or more kinds) of sheets P that have sheet sizes different from each other. For example, so as to deal with an inch-system sheet, an A4-size sheet and a B5-size sheet, the plurality of first hole portions 32 are formed in the bottom portion 31*a* of the sheet storage portion 31. Because of this, the side cursor 60 is inserted into a predetermined first hole portion 32 matching a sheet size, thereafter, the upper portion is fixed with the fastener 61, whereby the sheet P of the predetermined sheet size is positioned by the pair of side cursors 60 in the width direction. Here, the above fastener 61 is structured so as to be mountable/demountable without using a tool by grasping and rotating a knob portion 61*a*.

The end cursor 50 is composed of, for example, a resin material, and as shown in FIG. 14 to FIG. 17, has an elongate shaped first cursor 51, and a second cursor 56 that is rotatably supported by the first cursor 51. Besides, the second cursor 56 rotates, whereby the end cursor 50 is structured so as to be foldable. In other words, the second cursor 56 is structured so as to be foldable with respect to the first cursor 51. Here, FIG. 14 and FIG. 15 show a state in which the second cursor 56 is unfolded, while FIG. 16 and FIG. 17 show a state in which the second cursor 56 is folded. Besides, the first cursor 51 is an example of a "first member" of the present disclosure, and the second cursor 56 is an example of a "second member" of the present disclosure.

Besides, as shown in FIG. 2 and FIG. 14, the second cursor 56 is supported by one end portion (upper portion) of the first cursor 51. In other words, a support portion 57 supporting the second cursor 56 is situated at an upper position of the first cursor 51. On the other hand, at an end portion opposite to the side portion of the first cursor 51 where the second cursor 56 is supported, a pair of protrusion portions 52, which are inserted into the second hole portion 33 (see FIG. 2), are disposed.

The second hole portions 33, into which the end cursor 50 is inserted, are disposed like the first hole portion 32 so as to deal with a plurality of kinds of sheets P that have sheet sizes different from each other. In the present embodiment, for example, so as to deal with an A4-size sheet and a B5-size sheet, the plurality of second hole portions 33 are formed in the bottom portion 31*a* of the sheet storage portion 31.

Here, in the end cursor 50 as well, like in the side cursor 60, by only inserting the protrusion portion 52 of the end cursor 50 (first cursor 51) into a predetermined second hole portion 33, the end cursor 50 is likely to shake. Because of this, the end cursor 50, as shown in FIG. 2 and FIG. 3, is also fixed to the wall portion 31*b* of the sheet storage portion 31 with the protrusion portion 52 inserted in the second hole portion 33. According to this, even in a case where a large number of sheets P are stored, the shaking of the end cursor 50 is curbed.

Besides, as shown in FIG. 14, FIG. 18 and FIG. 19, the first cursor 51 of the end cursor 50 is provided, at both end portions in the width direction (the Y direction), with a pair of first engagement claws 51*a* that protrude (extend) toward the wall portion 31*b* (in an X2 direction). Besides, the second cursor 56 of the end cursor 50 is provided, at both end portions in the width direction (the Y direction), with a pair of second engagement claws 56*a*. In the second cursor 56, as shown in FIG. 2 and FIG. 14, when unfolding the second cursor 56 by 90° with respect to the first cursor 51, the second engagement claw 56*a* is structured so as to extend toward the wall portion 31*b* (in the X2 direction).

On the other hand, the wall portion 31*b* of the sheet storage portion 31, as shown in FIG. 2 and FIG. 3, is provided with a first engagement hole 34 with which the first engagement claw 51*a* of the first cursor 51 is engaged, and a second engagement hole 35 with which the second engagement claw 56*a* of the second cursor 56 is engaged. And, in a state in which the second cursor 56 is unfolded, as shown in FIG. 2 and FIG. 20, the second engagement claw 56*a* of the second cursor 56 is engaged with the second engagement hole 35 of the wall portion 31*b*. In a case where the second cursor 56 is folded, as shown in FIG. 3 and FIG. 21, the first engagement claw 51*a* of the first cursor 51 is engaged with the first engagement hole 34 of the wall portion 31*b*. Besides, the first engagement claw 51*a* and the second engagement claw 56*a* are each structured elastically deformably, and fitted and fixed in the first engagement hole 34, and the second engagement hole 35, respectively. As described above, the end cursor 50 is fitted in and fixed to the sheet storage portion 31, according to this, the end cursor 50 is fixed removably to the sheet storage portion 31.

And, the end cursor 50 (the first cursor 51) is inserted into a predetermined second hole portion 33 matching a sheet size, thereafter, the end cursor 50 is fitted into and fixed to the wall portion 31*b*, whereby the back end position of the sheet P of the predetermined size is restricted by the end cursor 50.

Besides, the first cursor 51 of the end cursor 50 has a function to restrict the back end position of the sheet P by coming into contact with the sheet P. Because of this, the end cursor 50 is inserted in the second hole portion 33 such that a surface of the first cursor 51, which comes into contact with the sheet P, becomes perpendicular to the bottom surface (the upper surface of the lift plate 30) of the sheet storage portion 31 (such that the end cursor 50 extends in a direction (Z direction) perpendicular to the bottom surface (the upper surface of the lift plate 30) of the sheet storage portion 31).

Here, in a case where the size of the stored sheet is small (e.g., a B5 size), as shown in FIG. 2, the end cursor 50 is inserted into the second hole portion 33 situated at a position that is spaced away from the wall portion 31*b*. In this case, the first cursor 51 of the end cursor 50 is spaced away from the wall portion 31*b*. Because of this, in such case, as shown in FIG. 2 and FIG. 20, the second cursor 56 is unfolded, and the second engagement claw 56*a* of the second cursor 56 is engaged with the second engagement hole 35 of the wall portion 31*b*.

On the other hand, in a case where the size of the stored sheet is large (e.g., an A4 size), as shown in FIG. 3, the end cursor 50 is inserted into the second hole portion 33 near the wall portion 31*b*. In this case, the first cursor 51 of the end cursor 50 comes close to the wall portion 31*b*. Because of this, in such case, as shown in FIG. 3 and FIG. 21, the second cursor 56 is folded, and the first engagement claw 51*a* of the first cursor 51 is engaged with the first engagement hole 34 of the wall portion 31*b*.

Here, as shown in FIG. 2, the second cursor 56 is designed with a dimension and the like such that when the second engagement claw 56*a* is engaged with the second engagement hole 35, the end cursor 50 (the first cursor 51) becomes perpendicular to the bottom surface (the upper surface of the lift plate 30) of the sheet storage portion 31, that is, the end cursor 50 extends in the direction (the Z direction) perpendicular to the bottom surface (the upper surface of the lift plate 30) of the sheet storage portion 31. Besides, as shown in FIG. 3, the first engagement claw 51*a* of the first cursor 51 is designed with a dimension and the like such that when the first engagement claw 51*a* is engaged with the first engagement hole 34, the end cursor 50 (the first cursor 51) becomes perpendicular to the bottom surface (the upper surface of the lift plate 30) of the sheet storage portion 31.

As described above, the end cursor 50 according to the present embodiment is structured such that even in a case where the insertion position (mounting position) for the end cursor 50 is changed in accordance with a sheet size, part of the end cursor 50 is fixable to the wall portion 31*b* of the sheet storage portion 31.

Besides, as shown in FIG. 18, at an end portion opposite to the second engagement claw 56*a* of the second cursor 56, a pair of mounting portions 58 for mounting the second cursor 56 on the first cursor 51 are unitarily disposed. This mounting portion 58 is structured so as to extend in an E direction and to be elastically deformable. Besides, end portions of the pair of mounting portions 58 are each provided with the support portion 57 (support shaft) that protrudes outward. Besides, each mounting portions 58 is provided with a protrusion portion 58*a* that protrudes outward.

This protrusion portion 58*a*, as shown in FIG. 14 and FIG. 23, has a function to restrict the rotation of the second cursor 56 by engaging with part of the first cursor 51 when the second cursor 56 is unfolded by 90° with respect to the first cursor 51. In other words, the state in which the second cursor 56 is unfolded is fixed (locked) by the protrusion portion 58*a*.

On the other hand, as shown in FIG. 19, an upper portion (end portion opposite to the protrusion portion 52) of the first cursor 51 is provided with a bearing hole 53 into which the support portion 57 (see FIG. 18) of the second cursor 56 is inserted. Besides, as shown in FIG. 19 and FIG. 22 to FIG. 24, near the bearing hole 53, a step portion 53*a* is disposed, into which the mounting portion 58 fits when the second cursor 56 is unfolded by 90° with respect to the first cursor 51. Because of this, thanks to this as well, the state in which the second cursor 56 is unfolded is fixed (locked).

Besides, as shown in FIG. 14, FIG. 15 and FIG. 18, the second cursor 56 is provided with a protrusion portion 59 that protrudes in the same direction (the X2 direction) as the second engagement claw 56*a*. Besides, the wall portion 31*b* of the sheet storage portion 31 is provided with a fit-in hole 36 (see FIG. 11, FIG. 13 and FIG. 20) into which the protrusion portion 59 is fitted. And, as shown in FIG. 20, when the second engagement claw 56*a* of the second cursor 56 is engaged with the second engagement hole 35 of the wall portion 31*b*, the protrusion portion 59 of the second cursor 56 is fitted into the fit-in hole 36. According to this, even in a case where the end cursor 50 is mounted with the second cursor 56 unfolded, the shaking of the end cursor 50 is more curbed.

Further, the protrusion portion 58*a* of the second cursor 56 has a function to release the fitting-in between the mounting portion 58 of the second cursor 56 and the step portion 53*a* of the first cursor 51 when the second cursor 56 is folded. Specifically, the second cursor 56 is folded from the state shown in FIG. 23 and FIG. 24 and via the state shown in FIG. 25 and FIG. 26. Here, as shown in FIG. 25 and FIG. 26, the mounting portion 58 is elastically deformed inward by the protrusion portion 58*a*. According to this, the fitting-in between the mounting portion 58 and the step portion 53*a* is released, so that the second cursor 56 is easily folded.

Here, the above end cursor 50 and the side cursor 60 have a function as well to guide the sheet P along a direction (vertical direction: the Z direction) in which the lift plate 30 moves up and down.

Figure 10:
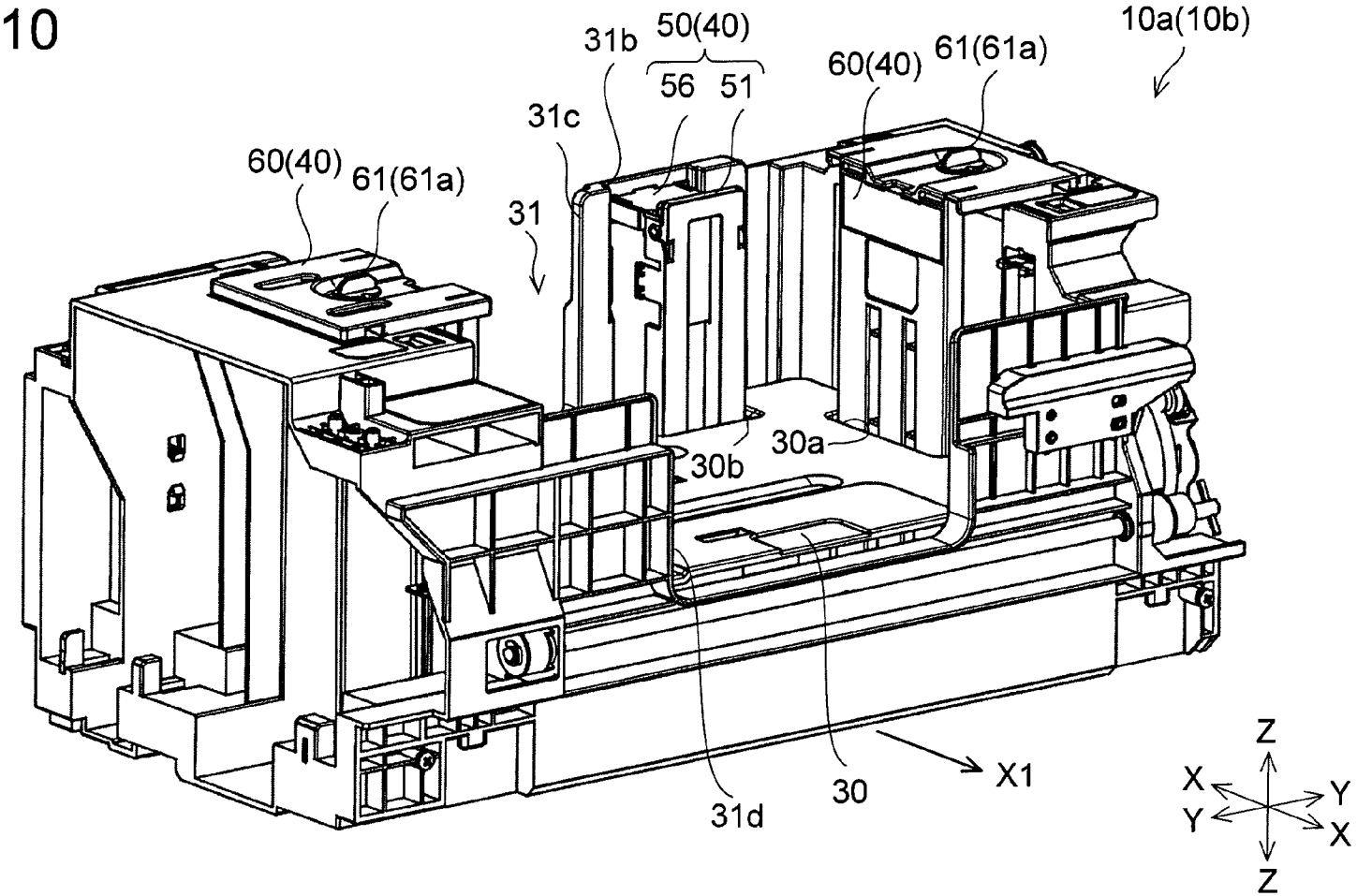
FIG. 10 is a perspective view (a view showing a state in which the end cursor 50 is mounted with the second cursor 56 unfolded) showing the sheet storage apparatuses 10*a*, 10*b* according to an embodiment of the present disclosure.
Figure 11:
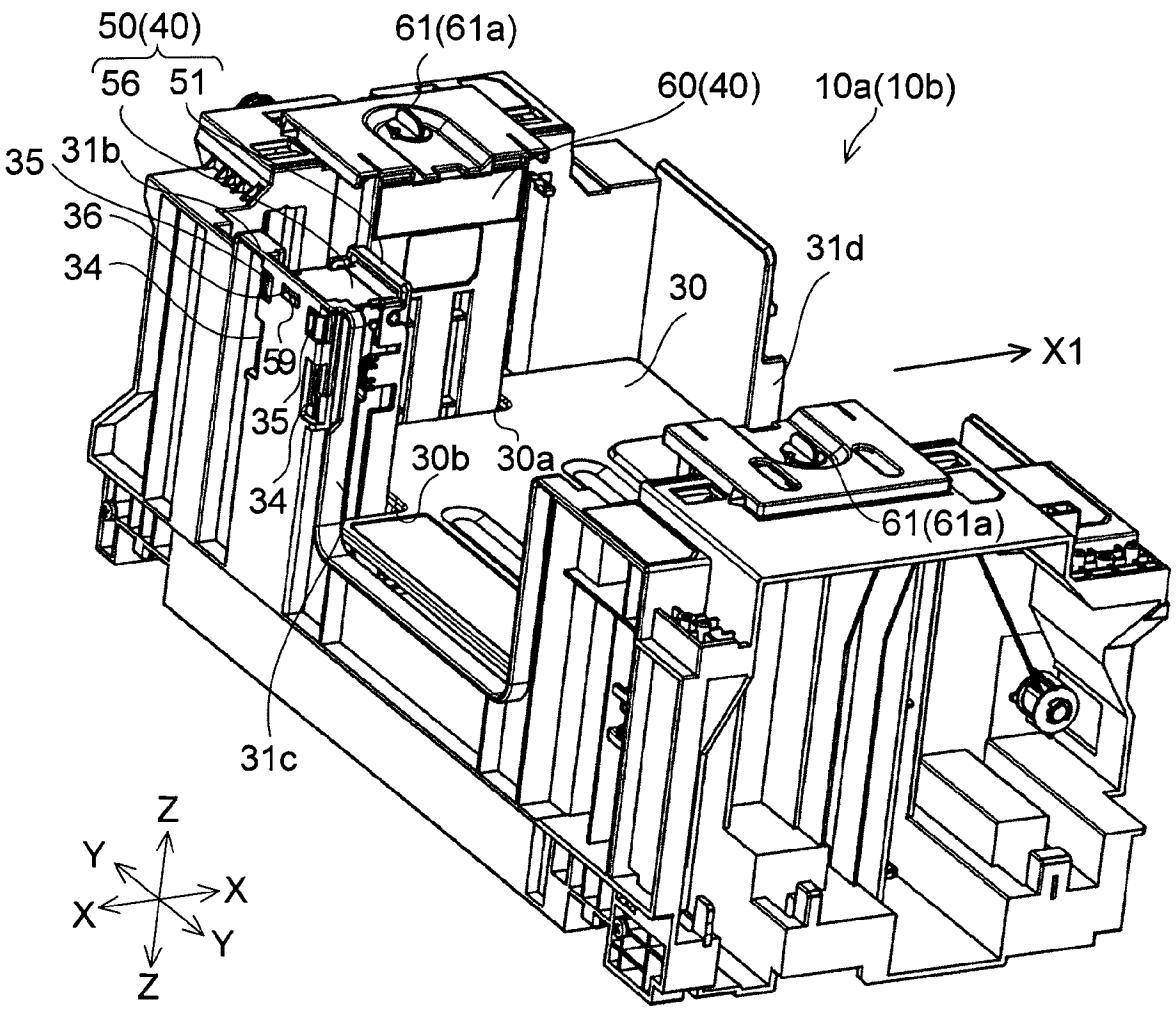
FIG. 11 is a perspective view (a view showing a state in which the end cursor 50 is mounted with the second cursor 56 unfolded) showing the sheet storage apparatuses 10*a*, 10*b* according to an embodiment of the present disclosure.
Figure 12:
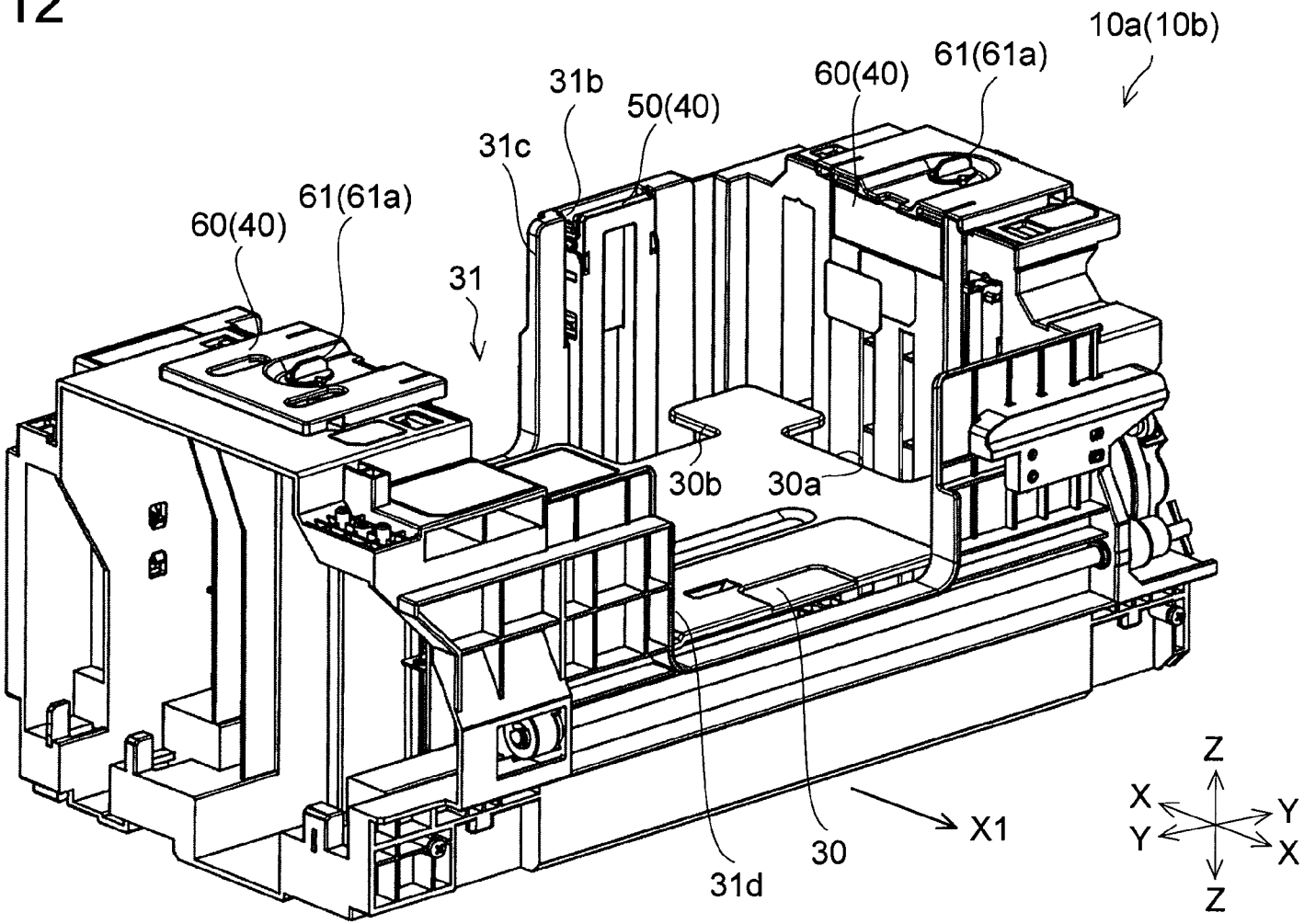
FIG. 12 is a perspective view (a view showing a state in which the end cursor 50 is mounted with the second cursor 56 folded) showing the sheet storage apparatuses 10*a*, 10*b* according to an embodiment of the present disclosure.
Figure 13:
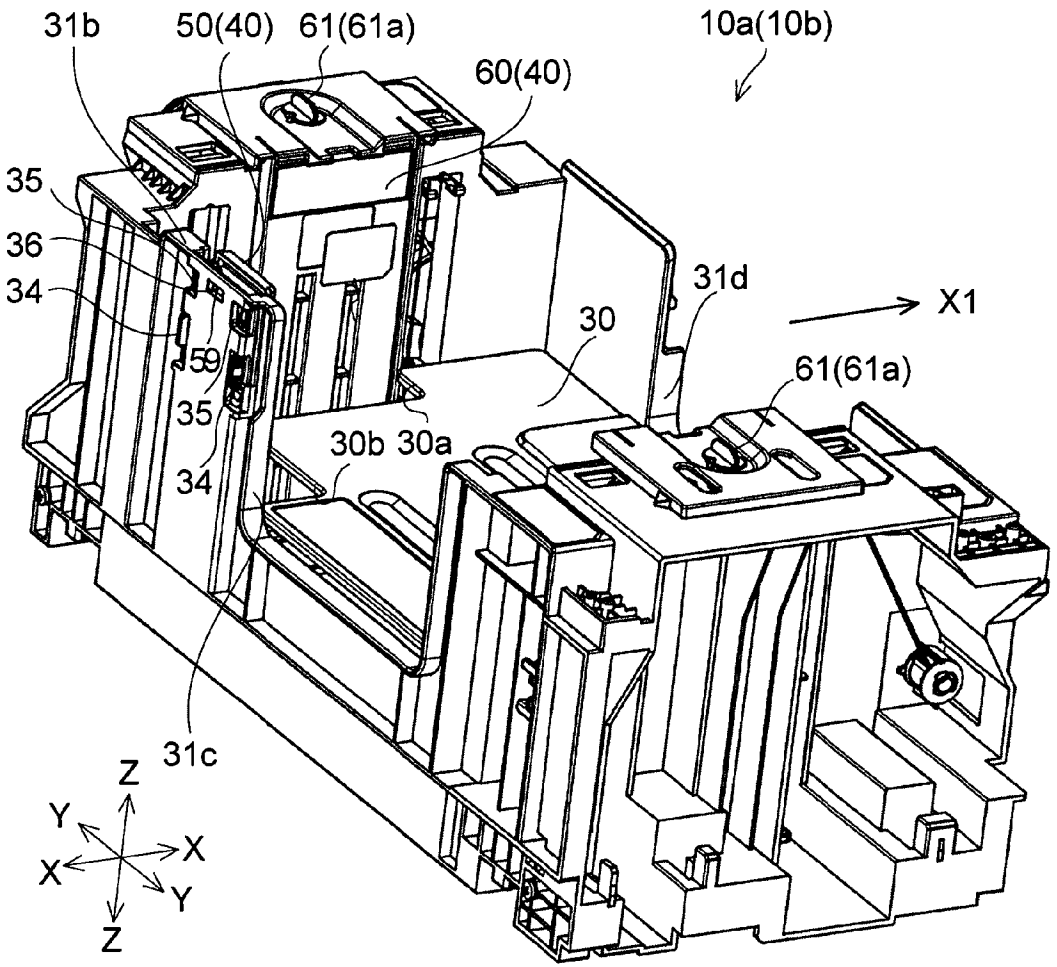
FIG. 13 is a perspective view (a view showing a state in which the end cursor 50 is mounted with the second cursor 56 folded) showing the sheet storage apparatuses 10*a*, 10*b* according to an embodiment of the present disclosure.

As described above, in the sheet storage apparatuses 10*a*, 10*b* according to the present embodiment, it is possible to easily change the mounting positions (insertion positions) of the end cursor 50 and the side cursor 60 in accordance with the sheet size, according to this, it becomes possible to easily restrict the position of the sheet P of the predetermined size. Here, FIG. 8, FIG. 10 and FIG. 11 show the state in which to store the sheet P of a sheet size (e.g., a B5 size), the end cursor 50 is mounted with the second cursor 56 unfolded. In this case, the side cursor 60 also is mounted at a position corresponding to the sheet size (e.g., the B5 size). Besides, FIG. 9, FIG. 12 and FIG. 13 show a state in which the end cursor 50 is mounted with the second cursor folded so as to store the sheet P of a larger sheet size (e.g., an A4 size). In this case, the side cursor 60 also is mounted at a position that corresponds to the sheet size (e.g., the A4 size). Besides, in a case where the sheet size belongs, for example, to the inch system, the sheet P is stored with the end cursor 50 demounted. In this case, the wall portion 31*b* of the sheet storage portion 31 functions as the restriction member that restricts the back end of the sheet P.

In the present embodiment, as described above, by structuring the end cursor 50 foldably, it is possible to change the insertion position (mounting position) of the end cursor 50 between the state in which the end cursor 50 is folded and the state in which the end cursor 50 is not folded (the state in which the second cursor 56 is unfolded). Because of this, by arbitrarily folding the end cursor 50 in accordance with a sheet size, it is possible to fix the end cursor 50 at a position (second hole portion 33) in accordance with the sheet size. Besides, the end cursor 50 is removably fixed in the sheet storage portion 31, so that it is possible to easily adjust the end cursor 50 in accordance with the sheet size.

Besides, by fitting and fixing the end cursor 50 into the bottom portion 31*a* and the wall portion 31*b* of the sheet storage portion 31, it is possible to easily mount and demount the end cursor 50 without using a tool. Besides, by fixing the end cursor 50 to the bottom portion 31*a* and the wall portion 31*b* of the sheet storage portion 31, for example, compared with a case where the end cursor 50 is fixed only to the bottom portion 31*a* of the sheet storage portion 31, it is possible to stably (without allowing the shaking) fix the end cursor 50. Especially, in a case of a large capacity sheet storage apparatus, several thousands of sheets are loaded (stored), accordingly, in the case where the end cursor 50 is fixed only to the bottom portion 31*a* of the sheet storage portion 31, the end cursor 50 easily shakes. On the other hand, as described above, by fixing the end cursor 50 to the bottom portion 31*a* and the wall portion 31*b* of the sheet storage portion 31, even in the case where several thousands of sheets P are loaded (stored), the shaking and the like of the end cursor 50 are curbed, so that it is possible to stably restrict the sheet positions.

Here, it is also possible to adjust the side cursor 60 like the end cursor 50 in accordance with the sheet size. In addition, even in the case where several thousands of sheets P are loaded (stored), the shaking and the like of the side cursor 60 are curbed, so that it is possible to stably restrict the sheet positions.

Besides, in the present embodiment, in the end cursor 50, the support portion 57 supporting the second cursor 56 is situated at the upper position of the first cursor 51, so that when the second cursor 56 is fixed to the wall portion 31*b*, it is possible to more stably mount the end cursor 50. Because of this, in the case where several thousands of sheets are loaded (stored), it is possible to more curb the shaking and the like of the end cursor 50.

Here, it is to be understood that the embodiment disclosed this time is an example in all respects and is not limiting. The scope of the present disclosure is not indicated by the above description of the embodiment but by the claims, and all modifications within the scope of the claims and the meaning equivalent to the claims are covered.

For example, in the above embodiment, the example is described, in which the end cursor 50 is disposed upright at one position in the sheet storage portion 31, however, the present disclosure is not limited to this, and a plurality of the end cursors 50 may be disposed upright at a plurality of positions (e.g., two positions) in the sheet storage portion 31.

Besides, in the above embodiment, the example is described, in which the end cursor 50 is structured so as to be foldable, however, the present disclosure is not limited to this, and the side cursor 60 may be structured so as to be foldable. Besides, both the end cursor 50 and the side cursor 60 may be structured so as to be foldable.

Besides, in the above embodiment, the example is described, in which the end cursor 50 is composed of the two members, that is, the first cursor 51 and the second cursor 56, however, the present disclosure is not limited to this, and the end cursor 50 (the cursor 40) may be composed of more than two members if the end cursor 50 is structured so as to be foldable.

Here, as shown in FIG. 27 and FIG. 28, the second cursor 56 of the end cursor 50 (the cursor 40) may be structured so as to be foldable into a plurality of sections (e.g., two sections). According to such a structure, it is possible to change the mounting position (fixing position) of the end cursor 50 to many positions, so that it is possible to deal with a plurality of kinds of sheets (e.g., three or more kinds) that have sheet sizes different from each other.

Besides, as shown in FIG. 29, it is also possible to structure the end cursor 50 such that a plurality of the second cursors 56 having lengths different from each other are rotatably supported by the first cursor 51 of the end cursor 50. According to such a structure as well, it is possible to fix the end cursor 50 at a position corresponding to a sheet size of a plurality of kinds (e.g., three or more kinds) of sheets having sheet sizes different from each other. Because of this, by changing the fixing position of the end cursor 50, it is possible to perform the size change so as to deal with more kinds (e.g., three or more kinds) of sheets.

Here, in the above embodiments, the example is described, in which the present disclosure is applied to a large capacity sheet storage apparatus, however, the present disclosure is not limited to this, and the present disclosure is also applicable to a sheet storage apparatus other than the large capacity sheet storage apparatus.

What is claimed is:

1. A sheet storage apparatus comprising:

a sheet storage portion that includes a bottom portion and a wall portion and that loads and stores a plurality of sheets; and a restriction member that is disposed in the sheet storage apparatus and restricts a sheet position; wherein the restriction member is composed of a first member that is removably fixed to the bottom portion, and a second member that is rotatable along the first member between a state in which it is folded to overlap the first member and a state in which it is elevated by a predetermined angle with respect to the first member, and that is removably fixed to the wall portion when elevated by the predetermined angle.

2. The sheet storage apparatus according to claim 1, wherein the restriction member includes a plurality of the second members.

3. The sheet storage apparatus according to claim 2, wherein the plurality of second members having different lengths are rotatably supported by the first member.

4. The sheet storage apparatus according to claim 1, wherein the second member is removably fixed to the wall portion when elevated by 90° with respect to the first member.

5. The sheet storage apparatus according to claim 1, wherein the first member and the second member are each fitted and fixed in the bottom portion and the wall portion of the sheet storage portion.

6. The sheet storage apparatus according to claim 5, wherein the first member has an elongate ruler shape, is fitted and fixed in the bottom portion of the sheet storage portion, and comes into contact with an end surface of the sheet; and the second member is rotably supported by the first member, and is fitted and fixed in the wall portion of the sheet storage portion when unfolded with respect to the first member.

7. The sheet storage apparatus according to claim 6, wherein a support portion for supporting the second member is situated at an upper position of the first member.

8. The sheet storage apparatus according to claim 5, wherein the first member is provided with a first engagement claw that is fitted into the wall portion of the sheet storage portion when the second member is folded along the first member.

9. The sheet storage apparatus according to claim 1, wherein the second member is supported foldably into a plurality of sections by the first member.

10. The sheet storage apparatus according to claim 1, wherein the restriction member includes a lock mechanism that holds the second member with the second member unfolded with respect to the first member.

11. The sheet storage apparatus according to claim 1, wherein at a plurality of positions in the sheet storage portion, the restriction member is disposed as an end restriction member that has a positioning function in a sheet convey direction and restricts a back end position of the sheet, and is disposed as a side restriction member that has a positioning function in a direction perpendicular to the sheet convey direction; and wherein the end restriction member is structured so as to be foldable.

12. The sheet storage apparatus according to claim 1, further comprising a lift plate that is disposed vertically movably in the sheet storage portion, wherein the restriction member includes a guide function to guide the sheet along a direction in which the lift plate moves up and down.

13. An image forming apparatus in which the sheet storage apparatus according to claim 1 is incorporated.

* * * * *